United States Patent [19]

Walz

[11] 4,247,014

[45] Jan. 27, 1981

[54] SELF-STORING PERMANENTLY ATTACHED OPENING MEANS

[76] Inventor: Karl Walz, 24 Purchase St., Worcester, Mass. 01606

[21] Appl. No.: 101,882

[22] Filed: Dec. 10, 1979

Related U.S. Application Data

[63] Continuation-in-part of Ser. No. 965,315, Dec. 1, 1978, abandoned.

[51] Int. Cl.[3] ..... B65D 41/32

[52] U.S. Cl. ..... 220/269

[58] Field of Search ..... 220/266–273

[56] References Cited

U.S. PATENT DOCUMENTS

| | | | |
|---|---|---|---|
| 3,744,667 | 7/1973 | Fraze et al. | 220/269 |
| 3,860,143 | 1/1975 | Strobe et al. | 220/269 |
| 3,923,193 | 12/1975 | Wells et al. | 220/269 |

*Primary Examiner*—George T. Hall
*Attorney, Agent, or Firm*—Lewis M. Smith, Jr.

[57] ABSTRACT

This invention relates to self-contained self-storing opening means for hollow containers such as thin-walled metal beverage cans customarily provided with attached opening means therefor arranged to be or able to be pulled loose from the can and discarded hazardously underfoot and typically featuring an opening therethrough with a hazardous raw metal edge. This invention provides a can cover including a flap portion and a pull tab, respectively having first and second mating portions mutually fixedly interfitted and permanently interconnected, located either fixedly in the cover or together rotatable with the flap portion inwardly of the can as it is opened, the pull tab having an annular end portion encircling the opening formed by breaking open the flap portion and covering the raw edge of this opening in its final protective position. Accordingly, the present invention is useful on beverage cans and other hollow containers needing non-hazardous permanently attached opening means.

7 Claims, 11 Drawing Figures

Fig. 4
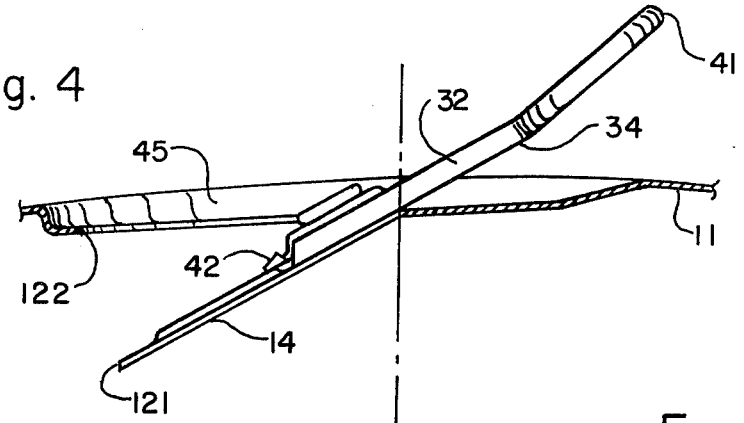
Fig. 5
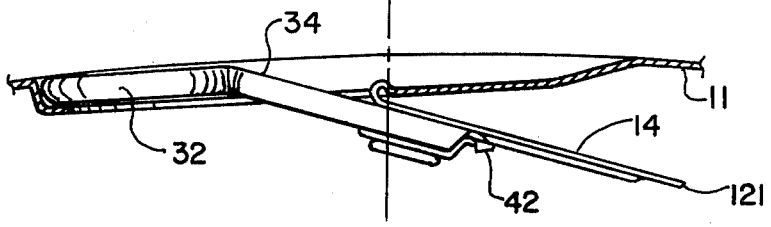
Fig. 6
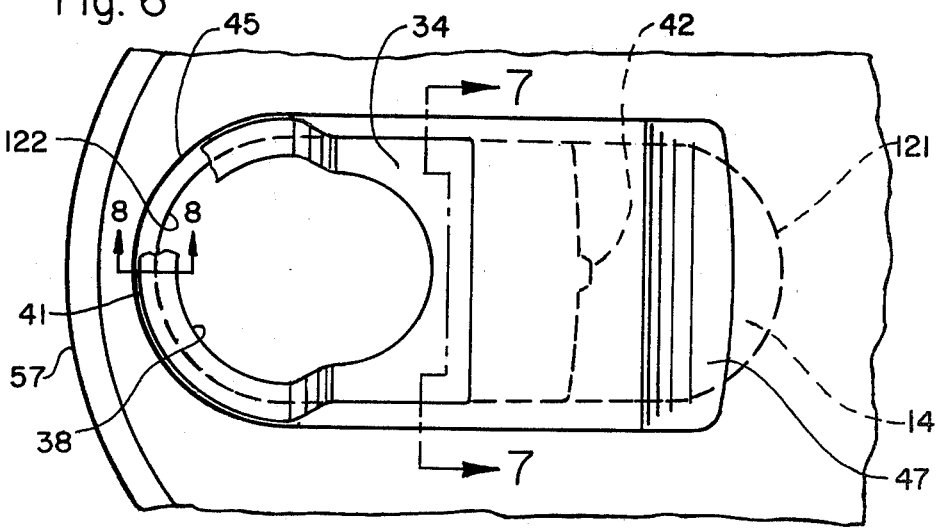
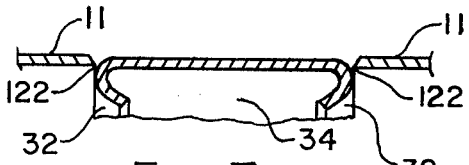
Fig. 7
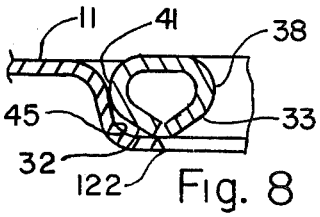
Fig. 8

Fig.9
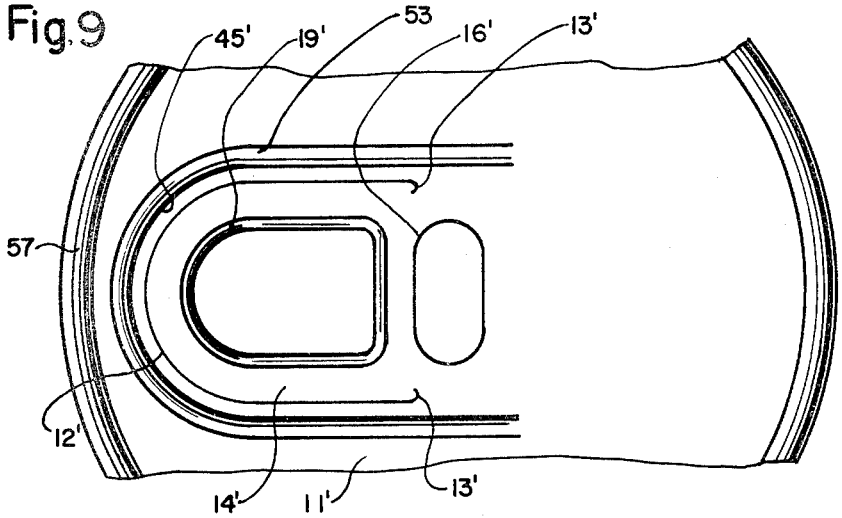
Fig.10
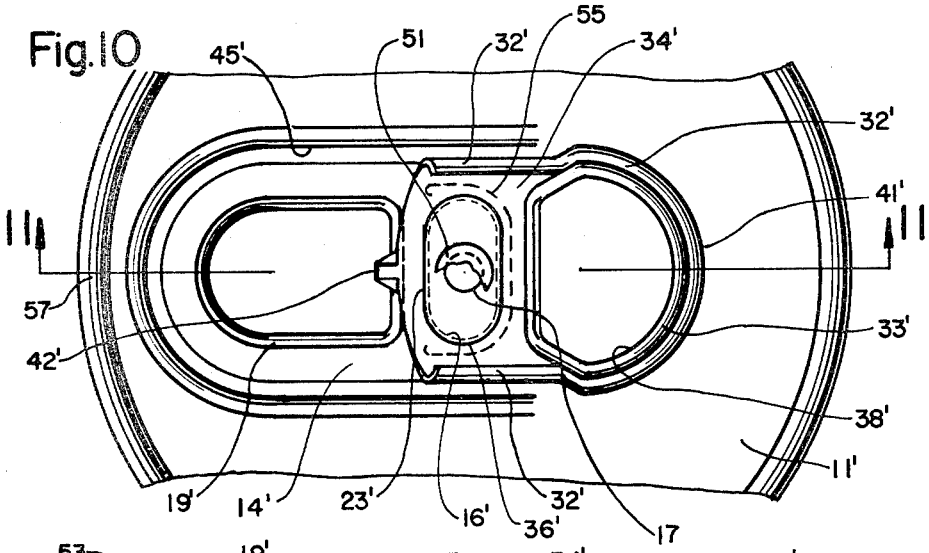
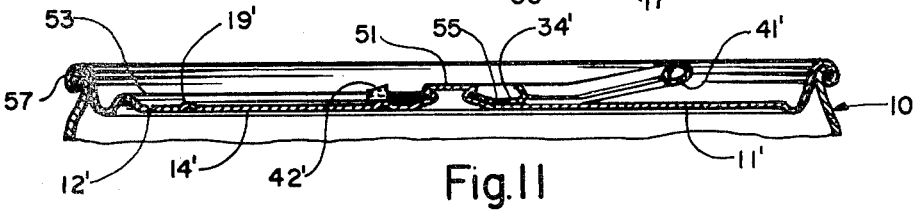
Fig.11

SELF-STORING PERMANENTLY ATTACHED OPENING MEANS

CONTINUING APPLICATION

This a continuing application in part based upon and claiming the filing date of copending U.S. patent application Ser. No. 965,315 filed Dec. 1, 1978, now abandoned.

FIELD OF THE INVENTION

This invention relates to self-contained manually operable opening means for a hollow container, and particularly to a self-storing permanently attached opening means for a hollow container such as a thin-walled beverage can or the like.

BACKGROUND OF THE INVENTION

Since the first widespread use of thin-walled metal beverage cans, it has been the general practice to incorporate on one end of each can a self-contained opening menas such as a pull tab connected to a tear flap or the like which can be manually displaced to break open the tear flap and thereby release the contents from the can. However, in some designs the pull tab and tear flap were arranged so that they were pulled free of a can and discarded when it was opened to become a hazard underfoot and unsightly. In other designs the pull tab was designed to remain attached to the can after it was opened, but projected from the open can so it could still be torn off and discarded to get it out of the way. In still another recently developed design the pull tab was completely eliminated, but in each of these designs the opening in the end of the metal container had an exposed raw metal edge dangerous to the fingers and the lips of a person using the contents of the can.

It is the purpose of the present invention to provide a pull tab in fact permanently attached to the end of a can manually moveable from an initial ready position adjacent the outer surface of the end of the can to break open a flap portion of the can end and rotate it inwardly of the can as the pull tab is rotated into and constrained in its final protective position against the outer surface of the can with a smoothly contoured annular portion thereof facing away from the outer surface of the end of the can and superposed over the raw edge of the opening in the end of the can formed by breaking open and rotating the flap portion of the can end.

The inventor is familiar with design details of various different opening means, particularly those for beverage cans, and has no knowledge of any prior art or any combination of prior art teachings embodying the several features arranged in the manner and for the purpose described and claimed below.

SUMMARY OF THE INVENTION

In one useful application of the present invention, a cylindrical thin-walled metal beverage can initially open at one end through which it is filled is thereafter closed and sealed with a thin-walled metal cover provided with a scored or partially sheared flap portion having adjacent a self-hinged end thereof a first coacting mating portion thereof. An elongated generally flat pull tab disposed against the outer surface of the cover has an annular end portion relatively remote from the flap portion of the cover and an opposite end portion including a second coacting mating portion thereof overlying the flap portion and the first coacting mating portion thereof. The respective first and second mating portions are permanently securely interconnected by suitable connecting means such as a self-rivet formed in one mating portion and flattened against the periphery of a hole through the other mating portion.

The elongated pull tab has its opposite end positioned against the flap portion of the cover so that lifting the annular end portion of the pull tab away from the cover breaks open the tab portion and rotates it about its self-hinged end along a predetermined hinge line controlled by the shape and location of the coacting mating portions so that the flap portion, the first and second coacting mating portions and the connecting self-rivet are all rotated into positions safely and securely within the can.

The cover is shaped to form a depression therein encircling the flap portion and conforming closely in size and shape to the periphery of the annular end portion of the pull tab and in depth to at least two-thirds of the effective thickness of the annular end portion of the pull tab, and the opposite edges of the pull tab are so spaced apart they are respectively engaged and constrained by the opposite edges of the opening in the cover formed by rotating the flap portion inwardly of the container. Consequently, the pull tab is constrained to remain in its final protective position with its annular end portion fitted snugly within the depression in the cover, so that it would be relatively difficult to displace even by a deliberate effort to do so.

The generally flat pull tab may be made from a sheet metal stamping with an elongated outer edge portion along both sides and around its annular outer end and an elongated inner edge portion surrounding the opening through its annular outer end both rolled to form a smoothly contoured safety surface facing against the outer surface of the cover with the annular end portion of the pull tab in its initial ready position for engagement by a person's finger tip to open the container, and facing away from the outer surface of the cover and nearly flush with it and covering the adjacent raw edge of the opening in the cover in its final protective position for safe engagement with the lips of a person drinking from the container.

BRIEF DESCRIPTION OF THE DRAWINGS

The distinctive features of the present invention are all shown in the several drawings herewith identified as follows:

FIG. 4 is a corresponding vertical section through the cover showing the pull tab lifted away from its initial ready postion and the flap portion broken open from the cover, FIG. 5 is a corresponding vertical section through the cover and a side view of the pull tab in its final protective position, FIG. 6 is a top plan view, partially broken away, showing the thin-walled cover and the pull tab shown also in FIG. 2, but with the pull tab in its final protective position corresponding to the showing in FIG. 5, FIG. 7 is a partial section, on section line 7—7 of FIG. 6, showing the constrained relationship between the opposite edges of the pull tab and the opposite edges of the opening through the cover, FIG. 8 is a partial section, on section line 8—8 of FIG. 6, showing the free end portion of the pull tab bearing against the side wall of the depression in the cover in the pull tab's final protective position.

FIG. 9 is a top plan view, partially broken away, showing a modified embodiment, preferred for ease of opening, of a thin-walled cover for a beverage can arranged to incorporate the instant invention, FIG. 10 is a top plan view, partially broken away, showing the embodiment of a thin-walled cover for a beverage can illustrated in FIG. 9 and a cooperating pull tab mounted in operative relation thereto, incorporating the instant invention, and FIG. 11 is a vertical section, on section line 11—11 of FIG. 10, through the cover and lengthwise of the pull tab in its initial ready position, both in the embodiment of the present invention illustrated in FIGS. 9 and 10.

DETAILED DESCRIPTION OF THE INVENTION

Figure 1:
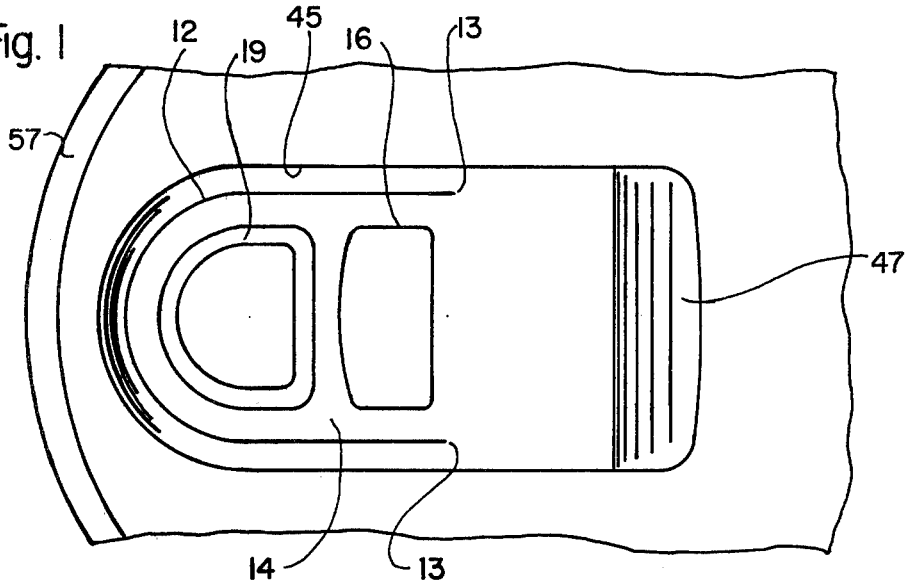
FIG. 1 is a top view, partially broken away, showing the basic embodiment of a thin-walled cover for a beverage can arranged to incorporate the instant invention.

Referring now more particularly to the showing in each of the respective drawings, wherein like reference numerals refer to like or corresponding parts, FIG. 1 shows details of one embodiment of a cover for an initial opening in a hollow container through which it is filled. After a hollow container is filled with a liquid or other pourable contents, the opening may be closed by a thin-walled cover as shown in FIG. 1 permanently attached to the hollow container to contain, protect and preserve its contents.

Figure 3:
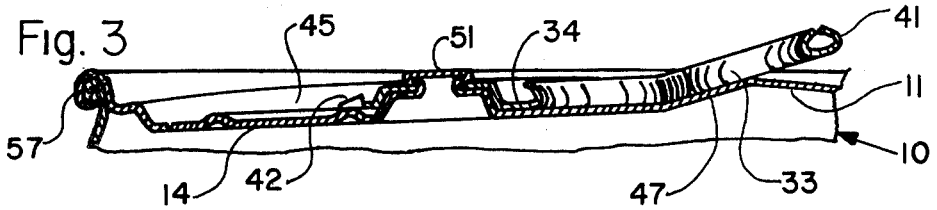
FIG. 3 is a vertical section, on section line 3—3 of FIG. 2 through the cover and lengthwise of the pull tab in its initial ready position.

For example, in the case of a hollow container comprising a cylindrical thin-walled beverage can fabricated from suitable sheet metal, the circular cover 11 maybe permanently attached to a beverage can generally designated by reference numeral 10 in FIG. 3 by rolling and sealing together the peripheral edges of the cover 11 and the opening in the can 10 to form the continuous joint 57 shown in section in FIG. 3, in the manner already well-known in the art.

The cover 11 features a depression therein defined by a U-shaped side wall 45 with its spaced opposite ends interconnected by a sloping ramp 47. The special significance of the size, shape and depth of this depression will be readily apparent from the following description of the inventive device.

The cover has provided therein a U-shaped parting line 12 with spaced apart opposite ends 13 scored in or partially sheared or otherwise partially cut through the thin-walled cover to form a U-shaped flap portion 14 which may be broken open manually to release the contents of the beverage can.

Figure 2:
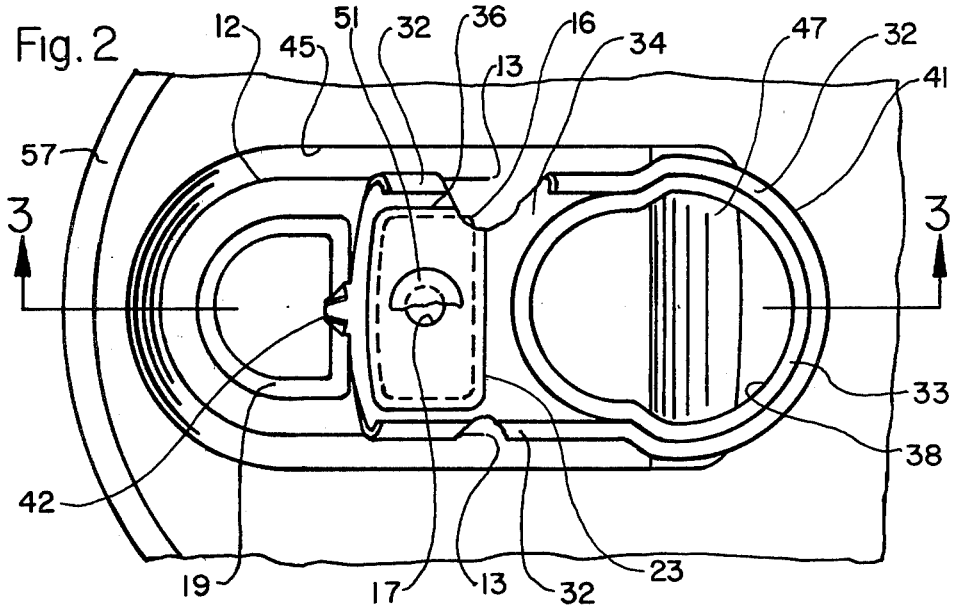
FIG. 2 is a top plan view, partially broken away, showing the same embodiment of a thin-walled cover for a beverage can and a pull tab mounted in operative relation thereto incorporating the instant invention.

The flap portion of cover 11 may be provided with a continuous stiffening rib 19 located centrally of flap portion 14, if necessary or desirable, to facilitate breaking open flap portion 14 manually by means of the elongated pull tab 34 shown in FIG. 2 and elsewhere.

Finally, the flap portion 14 of cover 11 is provided adjacent its self-hinged end with a first raised mating portion 16 arranged to coact with a second raised mating portion 36 of the pull tab 34 having a central hole 17 therethrough for insertion of and locking engagement by a self-rivet 51 shown best in FIG. 3 and elsewhere, formed centrally of mating portion 16.

Considering next FIG. 2 showing again the preferred embodiment of the cover 11 exactly as shown in FIG. 1 and described above, FIG. 2 also includes a showing of the elongated pull tab 34 which may be shaped from a thin sheet metal stamping to have a smoothly contoured working face by rolling an elongated outer edge portion 32 and a continuous elongated inner edge portion 33 as shown in section in FIG. 8 and elsewhere.

The elongated pull tab 34 has a free end forming a relatively enlarged annular end portion 41 and a projecting opposite end portion 42 in engagement with the stiffening rib 19 of flap portion 14 of the cover 11 and operable to break open the flap portion 14 when the end portion 41 of pull tab 34 is lifted as shown in FIG. 4.

As noted first above, the pull tab 34 includes a second raised mating portion 36 permanently secured in mutually interlocked engagement with the first mating portion 16 on the flap portion 14 of the cover 11 by suitable connecting means such as the self-rivet 51 formed centrally of mating portion 16. In addition, the second mating portion 36 has an elongated angularly off-set side face 23 disposed coaxially with the ends 13 of parting line 12 to establish and maintain the predetermined hinge line about which the flap portion is rotated inwardly of the can as shown in FIGS. 4, 5 and 6.

FIG. 3, a sectional view corresponding to the showing in FIG. 2, also shows the pull tab 34 in its initial ready position against the outer surface of the cover 11 with its annular end portion 41 adjacent the ramp 47 at one end of the depression in the cover 11.

FIG. 4, a similar sectional view, shows the annular end portion 41 of the pull tab 34 lifted away from the cover 11 to break open the flap portion 14 thereof inwardly of the can 10.

FIG. 5, another similar sectional view, shows the pull tab 34 in its final protective position against the outer surface of the cover 11 with its annular end portion 41 nested snugly within the depression in the cover 11 and with its smoothly contoured working face away from the cover 11 and substantially flush with the portion of the outer surface of the cover 11 encircling the side wall 45 of the depression shown to be of the proper size, shape and depth to receive the annular end portion 41 of the pull tab 34 positioned as shown in FIGS. 5 and 6.

FIG. 5 also shows best the final safe disposition of the raw edge 121 of the flap portion 14, the first and second mating portions 16 and 36 of flap portion 14 and pull tab 34, respectively, and self-rivet 51, al entirely within the can 10.

FIG. 6, a top plan view corresponding to the showing in FIG. 5, shows best how manually moving the pull tab 34 into its final protective position superposes the relatively enlarged annular end portion 41 thereof over the U-shaped raw edge 122 of the opening through the cover 11, in order to provide an entirely safe opening for removing the contents of the can 10 by drinking therefrom or otherwise.

FIG. 7 shows a detailed sectional view, on line 7—7 of FIG. 6, showing the opposite outer edge portions 32 of pull tab 34 preferably spaced slightly farther apart than the opposite sides of raw edge 122 of the opening through the cover 11, so that the opposite outer edge portions 32 are engaged and constrined by the opposite sides of the raw edge 122 as the pull tab 34 is positioned in its final protective position as shown in FIGS. 5 and 6. For example, this interference may be from 0.10 to 0.15 millimeter.

FIG. 8 shows a substantially enlarged detailed sectional view, on line 8—8 of FIG. 6 with the end portion 41 of pull tab 34 fitted snugly against the side wall 45 of the depression in cover 11 with most of the thickness of pull tab 34 within the depression. Any possible slight interference between the outer edge of the pull tab 34 and the conforming side wall 45 of the depression tending to prevent seating the pull tab 34 against the bottom of the depression in cover 11 is readily accomodated by slight deflection of supporting flap portion 14 along its self-hinge as the pull tab is pushed toward the bottom of the depression.

In contrast to the showing of the basic embodiment of the instant invention illustrated in FIGS. 1 through 8 and described above in relation to the showing in these figures, the modified embodiment of the instant invention illustrated in FIGS. 9, 10 and 11 may be preferred whenever it is desirable to facilitate the initial movement of the pull tab away from its ready position as shown in FIGS. 3 and 11 for the respective embodiments described herein.

Instead of a cover 11 featuring a depression therein defined by a U-shaped side wall, as shown in FIG. 1, FIG. 9 shows a flat cover 11′ featuring a U-shaped rib 53 upstanding from its outer surface having a U-shaped inner side surface 45′ thereof spaced outwardly from the periphery of a U-shaped flap portion 14′ of the cover 11′ defined by a U-shaped parting line 12′ provided in cover 11′ by scoring, a partial shearing or otherwise, and terminated at transversely spaced apart ends 13′ thereof, noting the relative location, the configuration and the purpose of side surface 45′ in this embodiment of the invention correspond to those of side surface 45 in the basic embodiment described above.

Instead of a cover 11 featuring a U-shaped flap portion 14 incorporating a first raised mating portion 16, as shown in FIG. 1, FIG. 9 shows a cover 11′ featuring a first raised mating portion 16′ thereof located adjacent to spaced apart ends 13′ of U-shaped flap portion 14′ but outside of the self-hinged end of flap portion 14′.

The flap portion 14′ of cover 11′ may be provided with a continuous stiffening rib 19′ located centrally of flap portion 14′, if necessary or desirable, to facilitate breaking open flap portion 14′ manually by means of the elongated pull tab 34′, resembling and corresponding to stiffening rib 19 shown in FIGS. 1 and 2 and described above.

FIG. 10 showing again the embodiment of cover 11′ shown in FIG. 9 also includes a showing of the elongated pull tab 34′ which may be shaped from a thin sheet metal stamping to have a smoothly contoured working face by rolling an elongated outer edge portion 32′ and a continuous elongated inner edge portion 33′ as shown in section in FIG. 11.

As shown in FIG. 10, the pull tab 34′ includes a second raised mating portion 36′ permanently secured in mutually interlocked engagement with the first raised mating portion 16′ on cover 11′ adjacent to flap portion 14′ by suitable connecting means such as self-rivet 51 formed centrally of mating portion 16′. In addition, the second mating portion 36′ has an elongated angularly off-set side face 23′ disposed coaxially with the ends 13′ of parting line 12′ to establish and maintain the predetermined hinge line about which the flap portion 14′ is rotated inwardly of the can 10.

The elongated pull tab 34′ is shaped at its free end to form a relatively enlarged annular end portion 41′ and has a projecting opposite end portion 42′ in engagement with the stiffening rib 19′ of flap portion 14′ of the cover 11′ and operable to break open the flap portion 14′ when the end portion 41′ of pull tab 34′ is lifted away from the outer surface of cover 11′, manually.

The pull tab 34′ is provided with the parting line 55 as shown in FIGS. 10 and 11, by being scored on its underside adjacent to the outer surface of the cover 11′ with the pull tab 34′ in its initial ready position, whereby rupture of the pull tab 34′ along its parting line 55 extending along one side and around both ends of the second raised mating portion 36′ thereof allows the annular free end portion 41′ to be lifted more easily in order to facilitate displacement of the opposite projecting end portion 42′ inwardly of the can 10 and thus against the stiffening rib 19′ of the flap portion 14′ to break open the flap portion.

When the pull tab 34′ is disposed in its final protective position against the outer surface of cover 11′ in a position corresponding to the final protective position of pull tab 34 as shown in FIG. 6, the additional opening through pull tab 34′ formed when the pull tab is ruptured along parting line 55 provides a relatively enlarged vent opening as compared to that of the basic embodiment of this invention, with the raw edge of this relatively enlarged but still small opening spaced from the rolled elongated edge portion 33′ and disposed adjacent the inner surface of the pull tab 34′ in its final protective position.

FIG. 11, a sectional view corresponding to the showing in FIG. 10, also shows the pull tab 34′ in its initial ready position against the outer surface of the cover 11′ with its annular end porgion 41′ positioned slightly spaced apart from the outer surface of the cover 11′ so it can be engaged easily by a person's fingertip.

In all other respects the embodiment of this invention shown in FIGS. 9, 10 and 11 and described immediately above corresponds fully to the showing of the basic embodiment of this invention shown in FIGS. 1 through 8 and described further above.

SUMMARY

Thus, the present invention provides a self-storing permanently attached opening means for a hollow container environmentally acceptable because the opening means is especially designed and constructed to remain securely attached to the container after it is used to open the container, which is particularly useful on a beverage can because the opening means is self-storing against the end of the can both in its initial ready position and in its final protective position after the can is opened, with its free annular end constrained in place against and covering the raw edge of the opening through the end of the can.

What is claimed is:

1. In combination with a hollow enclosed container for a quantity of liquid or other pourable contents, initially including an opening therethrough for filling said container thereafter enclosed by a thin-walled portion of said container comprising a cover for said opening suitably permanently attached to said container to contain, preserve and protect its contents and provided with a partially sheared generally U-shaped flap portion thereof including mutually spaced opposite ends thereof and arranged to be rotated inwardly of said container to form a corresponding U-shaped opening through which to release the contents thereof, a manually operative elongated pull tab with its free end arranged to be lifted away from said cover and its opposite end shaped and arranged to be biased against the flap portion of said cover when said pull tab is lifted to open the flap portion of said cover inwardly of said container, and coextensive and coacting mated portions of said pull tab and said cover respectively off-set outwardly of said container from the outer surfaces of said pull tab and said cover and having a purality of complementary mutually angularly off-set surfaces maintained in mutual engagement by connecting means permanently interconnecting said pull tab and said cover at said mated portions thereof, whereby the spatial relationship between the mated portions of said pull tab and said cover is maintained constant as the pull tab is lifted from said cover to open the flap portion of said cover, thereby maintaining said pull tab securely in engagement with said cover.

2. A device as described in claim 1, wherein:

said mated portions of said pull tab and said cover respectively include first and second coacting mutually engaged surfaces thereof respectively angularly off-set from the outer surfaces of said pull tab and said cover and disposed coaxially with and between the mutually spaced opposite ends of the U-shaped flap portion of said cover to form in combination therewith a hinge portion about which the flap portion of said cover may be rotated inwardly of said container by lifting said pull tab.

3. A device as described in claim 2, wherein:

one of said mated portions, off-set outwardly from said cover, is elongated and has its entire periphery, other than that portion thereof defined by the second of said coacting mutually engaged angularly off-set surfaces, located on said cover immediately adjacent to but outside said U-shaped flat portion of said cover, and the other of said mated portions, off-set outwardly from said pull tab, is elongated and has its entire periphery, other than that portion therof defined by the first of said coacting mutually engaged angularly off-set surfaces, located transversely of said pull tab and closely encompassed by a parting line in the pull tab arranged to be ruptured when said pull tab is lifted to open the flap portion of said cover, whereby said pull tab may be selectively manually released for facilitated rotation of said flap portion of said cover therewith about its predetermined hinge portion and inwardly of the container.

4. In combination with a hollow enclosed container for a quantity of liquid or other pourable contents, initially including an opening therethrough for filling said container thereafter enclosed by a thinwalled portion of said container comprising a cover for said opening suitably permanently attached to said container to contain, preserve and protect its contents and provided with a partially sheared generally U-shaped flap portion thereof including mutually spaced opposite ends thereof and arranged to be rotated inwardly of said container to form a corresponding U-shaped opening through which to release the contents thereof, a mutually operative elongated pull tab with its free end arranged to be lifted away from said cover and its opposite end shaped and arranged to be biased against the flap portion of said cover when said pull tab is lifted to break open the flap portion of said cover and rotate it inwardly of said container, said pull tab having a relatively enlarged free end comprising an annular portion encircling an opening therethrough and shaped and arranged to receive and accomodate comfortably a person's finger tip, and said pull tab being rotatable about a predetermined hinge line extending transversely of said pull tab and across said cover as said pull tab is rotated manually from an initial ready position adjacent said cover with its free end arranged to be engaged by a person's finger tip to a final protective position in which the annular portion thereof encircles the opening through said cover created by rotating the U-shaped flap portion of said cover inwardly of said container and forms a protective rim disposed closely adjacent said cover and superposed over the edge of such opening, said pull tab and said cover respectively including coextensive and coacting mated portions each having a plurality of mutually angularly off-set surfaces maintained in mutual engagement with complementary surfaces of the other by connecting means permanently interconnecting said pull tab and said cover at said mated portions thereof, and said mated portions of said pull tab and said cover respectively including first and second coacting mutually engaged surfaces thereof respectively angularly off-set from the adjacent outer surfaces of said pull tab and said cover and disposed coaxially with and between the mutually spaced opposite ends of the U-shaped flap portion of said cover, thereby establishing the predetermined hinge line about which said pull tab and the flap portion of said cover are rotatable, extending along said first and second mutually engaged surfaces and intersecting the mutually spaced opposite ends of the U-shaped flap portion of said cover.

5. A device as described in claim 4, wherein:

said pull tab incorporates first and second elongated portions respectively extending along the outer edge of said pull tab including its annular portion at its free end and along the entire inner edge of its annular portion, both rolled over in the same direction relative to the central portion of said pull tab, whereby said pull tab is provided with an uninterrupted smoothly contoured surface positioned facing toward the outer surface of said cover when said pull tab is in its initial ready position, for safe engagement by a person's finger, and positioned facing away from the outer surface of said cover when said pull tab is in its final protective position, for safe engagement with a person's lips, and said first elongated portion comprises first and second elongate side sections respectively extending lengthwise along the opposite sides of said pull tab from the predetermined hinge line past the opening therthrough toward the free end thereof and from the predetermined hinge line past the opposite sides of the coacting mated portions toward the other end thereof, whereby said pull tab is stiffened against bending about the predetermined hinge line or elsewhere as said pull tab is rotated manually from its initial ready position to its final protective position.

6. A device as described in claim 4, wherein:

said elongated pull tab has a relatively reduced width from its relatively enlarged free end to its opposite end defined by elongate side surfaces mutually so spaced apart and so disposed relative to the predetermined hinge line as to be automatically engaged with the opposite edges of the U-shaped opening formed in said cover by rotation of the U-shaped flap portion of said cover inwardly of said container as said pull tab is rotated from its initial ready position into is final protective position, whereby said pull tab is frictionally constrained in its final protective position adjacent said cover.

7. A device as described in claim 6, wherein:

said cover is provided with a depression therein below the adjoining outer surface thereof so shaped and arranged it receives more than two-thirds the thickness of said pull tab with said pull tab in its final protective position adjacent said cover.

* * * * *